United States Patent [19]

Crew

[11] Patent Number: 4,832,357

[45] Date of Patent: May 23, 1989

[54] ROCKER APPARATUS FOR USE ON A WHEELCHAIR

[76] Inventor: Randolph E. Crew, 110 Stonehedge Dr., Greenville, S.C. 29615

[21] Appl. No.: 213,717

[22] Filed: Jun. 30, 1988

[51] Int. Cl.[4] ..... A47C 13/00

[52] U.S. Cl. ..... 280/304.1; 280/8; 280/13; 297/133

[58] Field of Search ..... 280/289 WC, 242 WC, 280/7.12, 7.14, 8, 13; 297/133, 272

[56] References Cited

U.S. PATENT DOCUMENTS 3,306,660 2/1967 Williams ..... 280/8 X 4,118,046 10/1978 Vaughan ..... 280/289 WC

*Primary Examiner*—John A. Pekar

*Attorney, Agent, or Firm*—Bailey & Hardaway

[57] ABSTRACT

A rocker apparatus for use on a wheelchair is illustrated as including arcuate members carried on opposed sides of an unobstructed base, a means for securing the wheelchair to the base, a trough for accommodating large rear wheels of the wheelchair to prevent rolling during rocking and ramps for easy entrance on to and exit from the apparatus.

5 Claims, 2 Drawing Sheets

ROCKER APPARATUS FOR USE ON A WHEELCHAIR

BACKGROUND OF THE INVENTION

A rhythmic rocking motion, as achieved with a rocking chair, is well known as providing a general soothing and relaxing feeling. It has additionally been found that for those confined to a wheelchair, a rocking motion provides a degree of seat pressure relief that reduces the risk of skin breakdown. The rocking motion also provides vestibular stimulation which is advantageous in the treatment of patients having a brain injury or brain related condition.

A rocking wheelchair apparatus is illustrated in U.S. Pat. No. 3,306,660 wherein a wheelchair of a specific width could be rolled on to arcuate members separated by spanning means and then locked into place. However, in using that apparatus the wheels of the wheelchair must be carefully rolled into narrow slots on the arcuate members. To use the device on wheelchairs of different widths as are commonly encountered in nursing homes the spanning members defining the distance between the arcuate members must be readjusted with every use. Also, that apparatus only includes one means for preventing the wheelchair from rolling while rocking. Moreover, in apparatus of the prior art it sometimes happens that both front and rear wheels, which may be of different spacing, may not be accommodated within the grooves.

Thus, it is an important object of this invention to provide a rocker apparatus for use on a wheelchair which can be used on a wheelchair of any width accommodated by its arcuate rocker members without having adjustments.

Another important object of this invention is the provision of a rocker apparatus for use on a wheelchair having, in addition to a means for securing the wheelchair to the apparatus, a means for preventing any rolling, sliding or turning over during rocking.

It is yet another object of this invention to provide a rocker apparatus for use on a wheelchair having means for easily wheeling the wheel chair on to and off of the apparatus.

SUMMARY OF THE INVENTION

It has been found that a rocker apparatus for use on a wheelchair may be provided having arcuate members carried on opposed sides of a base, the base including front and rear ramps, a means for securing the wheelchair thereto and a trough substantially conforming to large, rear wheels of the wheelchair to prevent any rolling or sliding of the wheelchair about the base during rocking.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate a rocker apparatus for use on a wheelchair. An arcuate rocker base A for carrying the wheelchair has longitudinal spaced arcuate members B carried by respective opposed sides. A transverse arcuate, concave trouch C is defined in base A for accommodating large, rear wheels of the wheelchair while front wheels of the wheelchair are carried on a forward portion of the base. The apparatus additionally includes a means D for securing the wheelchair to the base with the base otherwise unobstructed for receiving wheels of the wheelchair of any given spacing between the spaced arcuate members. A rear ramp E extends downwardly from a rear portion o the base for easily wheeling the wheelchair on to and off of the base. Additionally, a front ramp F extends downwardly from a forward portion of the base for easily wheeling the wheelchair forwardly off of said base.

Figure 2:
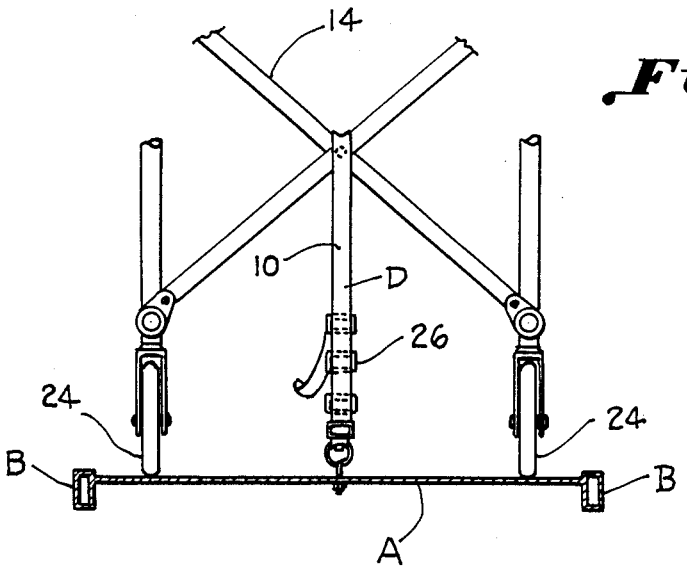
FIG. 2 is a transverse sectional elevation taken along the line 2—2 of FIG. 1 illustrating a means for securing the wheelchair in accordance with the invention.
Figure 1:
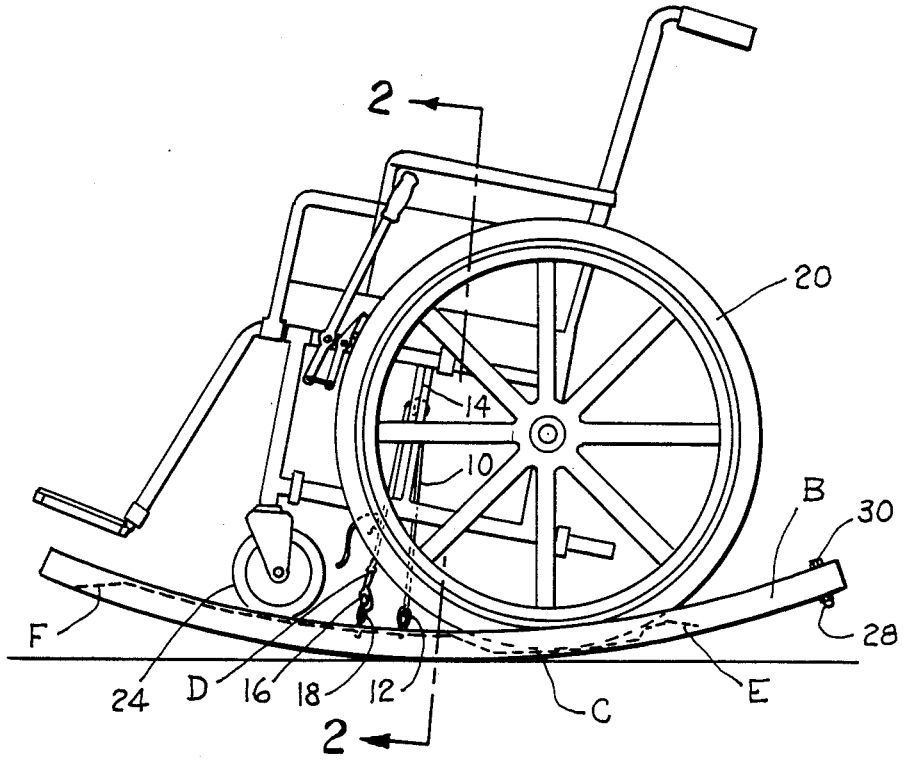
FIG. 1 is a side elevation illustrating a rocker apparatus constructed in accordance with the invention with a wheelchair carried thereon, with broken lines illustrating the structure of the base.
Figure 3:
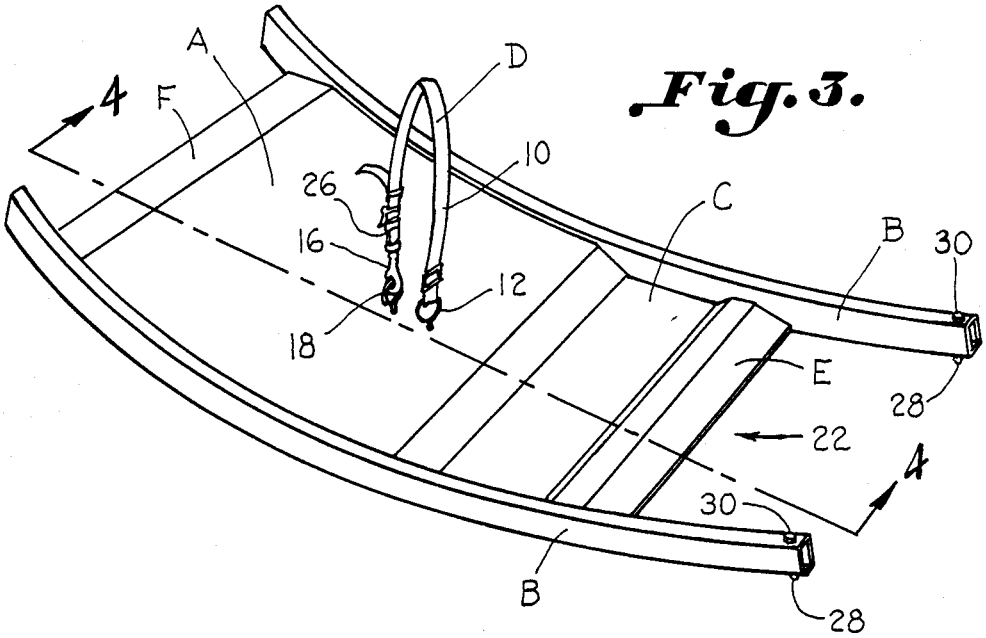
FIG. 3 is a perspective view of a rocker apparatus constructed in accordance with this invention.
Figure 4:
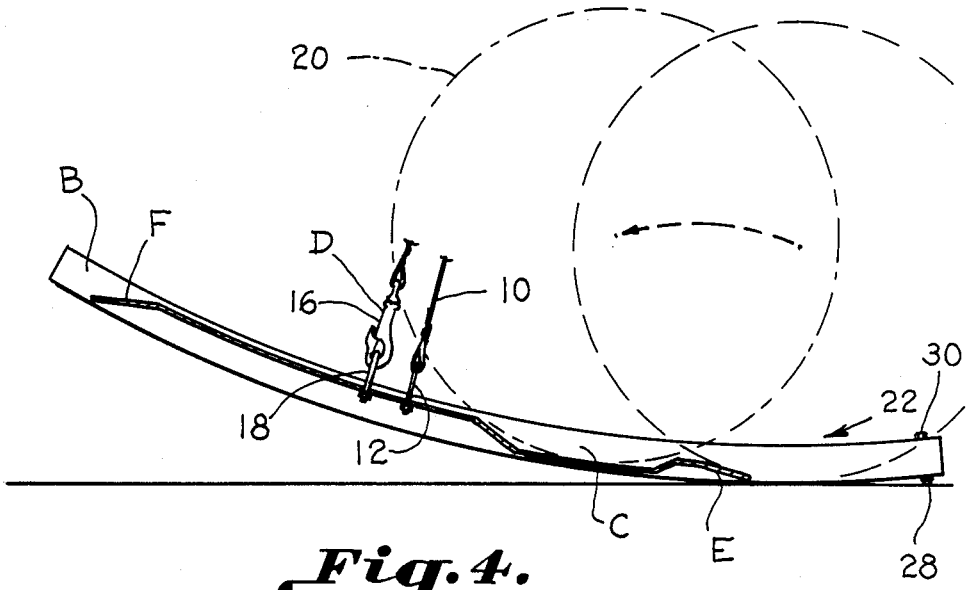
FIG. 4 is a longitudinal sectional elevation taken along the line 4—4 of FIG. 3 with broken lines illustrating large rear wheels of a wheelchair as they are wheeled into place on the apparatus.

Referring more particularly to the drawings, the means D for securing the wheelchair to the base is a strap 10 carried by a rear eye bolt 12 which is passed over wheelchair crossbars 14 from rear to front as shown in FIG. 1, and fastened by a snap bolt 16 carried on a distant end thereof to forward eye bolt 18.

For additional security and to prevent any slight rolling during rocking, trough C receives large, rear wheels 20 of the wheelchair.

Thus, a user seats in a wheelchair enters the rocker apparatus by rolling the wheelchair forward toward a rear portion 22 of the base until small front wheels 24 are on rear ramp E. The user rolls the front wheels up the rear ramp, on to the base and into the trough and then continues rolling forwardly until the rear wheels are in the trough. The brakes on the wheelchair are then locked. The independent user, one who can bend over fully at the waist, then reaches over, passes strap 10 over crossbars 14 and snaps it in place of front eye bolt 18.

Strap 10 further includes adjustment means 26 so that the user may tighten the strap. A dependent user requires an assistant to fasten and tighten the strap. To exit the rocker apparatus the user or his assistant unfastens the strap and passes it back over the crossbars, unlocks the wheelchair brakes and then rolls the wheelchair either forwardly off front ramp F or backwardly off rear ramp E. Stops 28 are fastened on the ends of arcuate members B as by bolts 30 to prevent over rocking.

Thus, it is shown that a rocker apparatus is provided that will accommodate a wheelchair of any width limited only by the distance between the arcuate members as defined by the width of the base.

While a preferred embodiment of the invention has been described using specific terms, such description is for illustrative purposes only, and it is to be understood that changes and variations may be made without departing from the spirit or scope of the following claims.

What is claimed is:

1. A rocker apparatus for use on a wheelchair comprising:

an arcuate rocker base for carrying said wheelchair;

longitudinal spaced arcuate members carried by respective opposed sides of said base;

a transverse trough within said base for accommodating large rear wheels of said wheelchair for engagement therein with front wheels upon a forward portion of said rocker base;

means for securing said wheelchair upon said base;

said base being unobstructed for receiving wheels of the wheelchair of any given spacing between the spaced arcuate members; and a rear ramp extending downwardly from a rear portion of said base for easily wheeling said wheelchair on to and off of said base;

whereby said wheelchair may be of any width accommodated between said arcuate members; and whereby a user seated in said wheelchair rolls front wheels of the wheelchair up the rear ramp and on to the base and rolls said wheelchair forwardly until the rear wheels are seated in said trough and secures the wheelchair to the base by said means for securing said wheelchair.

2. The structure set forth in claim 1 further including a front ramp extending downwardly from a forward portion of said base for easily wheeling said wheelchair forwardly off of said base.

3. The structure set forth in claiim 1 wherein said securement means is a strap carried by said base for extending about a portion of said wheelchair.

4. A rocker apparatus for use on a wheelchair comprising:

a continuous arcuate rocker base for receiving wheels of the wheelchair;

longitudinal spaced arcuate members carried by respective opposed sides of said base;

means for securing said wheelchair upon said base;

said base being unobstructed for receiving wheels of the wheelchair of any given spacing between the spaced arcuate members; and a rear ramp extending downwardly from a rear portion of said base for easily wheeling said wheelchair on to and off of said base;

whereby said wheelchair may be of any width accommodated between said arcuate members.

5. A rocker apparatus for use on a wheelchair comprising:

an arcuate rocker base for carrying said wheelchair;

longitudinal spaced arcuate members carried by respective opposed sides of said base;

a transverse trough defined within said base for accommodating large, rear wheels of said wheelchair;

said trough substantially conforming to a lower portion of said rear wheels;

means for securing said wheelchair upon said base; and a rear ramp extending downwardly from a rear portion of said base for easily wheeling said wheelchair on to and off of said base;

whereby a user seated in said wheelchair rolls front wheels of the wheelchair of the rear ramp and on to the base and rolls said wheelchair forwardly until the rear wheels are seated in said trough and secured the wheelchair to the base by said means for securing said wheelchair; and whereby said wheelchair is prevented from rolling of sliding about said base seating said large, rear wheels within the trough.

* * * * *